United States Patent [19]

Fujimori et al.

[11] 4,225,344

[45] Sep. 30, 1980

[54] PROCESS FOR PRODUCING SINTERED HARD METALS AND AN APPARATUS THEREFOR

[75] Inventors: Naoji Fujimori; Masaya Miyake; Takaharu Yamamoto; Akio Hara, all of Itami, Japan

[73] Assignee: Sumitomo Electric Industries, Ltd., Japan

[21] Appl. No.: 925,697

[22] Filed: Jul. 17, 1978

[30] Foreign Application Priority Data

Jul. 17, 1977 [JP] Japan ..... 52/85923

[51] Int. Cl.[3] ..... B22F 3/00; C22C 1/05

[52] U.S. Cl. ..... 75/203; 75/204; 75/221; 75/224; 148/126

[58] Field of Search ..... 75/224, 203, 204, 221; 252/373; 148/20.3, 126

[56] References Cited

U.S. PATENT DOCUMENTS

| | | | |
|---|---|---|---|
| 2,244,052 | 6/1941 | Comstock | 75/224 |
| 2,829,427 | 4/1958 | Tacuorian et al. | 75/224 X |
| 3,306,741 | 2/1967 | Lallemant | 75/224 |
| 3,752,655 | 8/1973 | Ramquist | 75/224.8 |

*Primary Examiner*—Richard E. Schafer

*Attorney, Agent, or Firm*—Wenderoth, Lind & Ponack

[57] ABSTRACT

This invention relates to a process for producing sintered hard metals which comprises sintering a compact for the sintered hard metals or sintering a formed body obtained from the compact through a presintering treatment and, if necessary, a machining treatment, a part or all of the heating steps and cooling steps being carried out in an atmospheres of hydrogen and an atmosphere of carbon monoxide.

6 Claims, 6 Drawing Figures

PROCESS FOR PRODUCING SINTERED HARD METALS AND AN APPARATUS THEREFOR

BACKGROUND OF THE INVENTION

1. Field of the Invention

This invention relates to a process of producing sintered hard metals, in particular, cemented carbides and an apparatus therefor and more particularly, it is concerned with a method of sintering cemented carbides whereby the dispersion of qualities of products can be decreased, which is unavoidable in the vacuum sintering method commonly used for sintering cemented carbides.

2. DESCRIPTION OF THE PRIOR ART

Cemented carbides are produced ordinarily by the powder metallurgical method wherein powdered starting materials are mixed, pressed, if necessary subjected to presintering and machining and then subjected to final sintering at 1300° to 1500° C. to give a pore-free product. Of various dispersed properties of the product occurring during this production process, the quantity of carbon (which will hereinafter be referred to as "carbon content") requires the most precise control, since the allowable range of carbon content is less than 3% within which limit cemented carbides are capable of acting well and if the carbon content is low, a brittle $\eta$-phase is precipitated, while if the carbon content is high, free carbon is precipitated. Furthermore, it is well known that a slight difference in carbon content has a marked influence upon the property of cemented carbides even within the allowable range.

The commonly used sintering method is a vacuum sintering method by which, however, it is very difficult to prepare cemented carbides with a stable carbon content. The reason thereof is as follows: Various starting material powders for cemented carbides are fine and the mixed powder (which will hereinafter be referred to as "starting mixed powder") obtained therefrom through ball milling by wet process has such a very fine particle size that the specific surface area amounts to several $m^2/g$. Such a fine powder, upon exposure to the air, is easily ozidized with oxygen and moisture contained in the air. One of the inventors has made detailed studies on this phenomenon [Akio Hara: Study on Oxidation of Starting Material Powders for Cemented Carbides in Air at Normal Temperature in "Funtai oyobi Funmatsu Yakin (Journal of the Japan Society of Powder and Powder Metallurgy)", Vol. 17, No. 8, page 338 (1971)]. According to this study, the oxidation phenomenon of a powder is a kind of rusting phenomenon forming hydroxides in the air. In the heating step of vacuum sintering, this hydroxide is reduced with carbon and, consequently, the carbon content of a compact is decreased during sintering, depending on the quantity of the hydroxide. Since formation of hydroxides tends to be affected by the weather, the carbon content in the product fluctuates with the weather. In order to prevent this phenomenon, handling of starting mixed powders and production facilities have hitherto been considered seriously, but dissipation of the quality of the product cannot be sufficiently suppressed by vacuum sintering.

A method for preventing the decrease of carbon content by reducing the hydroxides with hydrogen is effective in some aspects, but causes certain problems as follows:

The first cause is based on the following reducing reaction (1), $$H_2+(O)\rightarrow H_2O \quad (1)$$

in which (O) is oxygen contained in the hydroxides or oxides. The course of this reaction depends on the value of $P_{H2O}/P_{H2}$ and, therefore, it is necessary to raise the purity of hydrogen to be fed to a sintering furnace (i.e., to decrease $H_2O$) in order to accomplish the reaction sufficiently. Since $H_2O$ is generated by the reaction, however, the hydrogen atmosphere has only a low reducing capacity even if high purity $H_2$ is used unless $H_2O$ is removed sufficiently rapidly. As described above, the starting mixed powders for cemented carbides are very fine, so a compact thereof is a porous body having very fine pores and hydroxides are considered to be formed on the walls of pores (inner surfaces). For the purpose of effecting the reducing reaction in the pores sufficiently, it is necessary to remove $H_2O$ rapidly and to introduce $H_2$ for the above described reasons. Using the ordinary hydrogen furnace, therefore, movement of $H_2$ is not sufficiently carried out and reduction with $H_2$ is not satisfactory.

The second cause is based on the following reaction (2) because a compact and presintered body are carbonaceous and structural parts of carbon are used in a furnace:

$$C+2H_2\rightleftarrows CH_4 \quad (2)$$

This reaction proceeds to the right at 600° C. or lower under a total pressure of 1 atm, which corresponds to a decarburization reaction for a compact to be sintered, and proceeds to the left at 600° C. or higher, which corresponds to a carburization reaction. It is difficult to keep uniform the temperature at all sites of the furnace and the flow of hydrogen gas results often in nonuniform conditions, so that both reactions of decarburization and carburization take place and the dissipation of quality is remarkable, depending on the sites in the furnace. Control or reduction of this problem is difficult.

The third cause is based on the following decarburization reaction (3) at 900° C. or higher:

$$H_2O+C\rightarrow CO+H_2 \quad (3)$$

In this case $H_2O$ is also a problem, which is not introduced as an impurity in hydrogen, but is formed by the reducing reaction or separated from absorbed $H_2O$ in the furnace.

The above described three reactions are in complicated relation with each other and control of these reactions, therefore, is more difficult than in the case of a vacuum furnace. In particular, the reactions (2) and (3) at high temperatures are unfavorably affected by the presence of hydrogen gas itself. Of late, therefore, the hydrogen sintering method has scarcely been employed.

SUMMARY OF THE INVENTION

It is an object of the present invention to provide a process for producing sintered hard alloys, in particular, cemented carbides or carbonitrides.

It is another object of the present invention to provide a process for sintering a cemented carbide alloy whereby the dissipation in quality of the products can be reduced, which is unavoidable in the vacuum sintering method commonly used for producing cemented carbides.

It is a further object of the present invention to provide a process for sintering or cementing carbides, or carbonitrides, whereby the control of the carbon content can readily by achieved.

It is a still further object of the present invention to provide an apparatus for producing sintered hard metals, in particular, cemented carbides or carbonitrides.

These objects can be attained by a process for producing sintered hard metals which comprises sintering a compact for the sintered hard metal or a formed body obtained therefrom through a presintering treatment and, if necessary, a machining or shaping treatment, a part or all of the heating steps and cooling steps being carried out in both an atmosphere of hydrogen and an atmosphere carbon monoxide and by an apparatus for producing sintered hard metals by sintering a compact for the sintered hard or a product or formed body obtained therefrom through a presintering treatment and, if necessary, a machining or shaping treatment, comprising a furnace to be charged with a compact to be sintered, the furnace having a gas inlet, a gas outlet and an exhaust means, in which the gas flow rate to the furnace is controlled by a valve fitted to the gas inlet, the inner pressure of the furnace is controlled by a valve fitted between the gas outlet and the exhaust means and heating and cooling steps are carried out with a predetermined gas flow rate and pressure.

BRIEF DESCRIPTION OF THE DRAWING

The accompanying drawings are to illustrate the principle and merits of the invention in more detail.

DETAILED DESCRIPTION OF THE INVENTION

Figure 1:
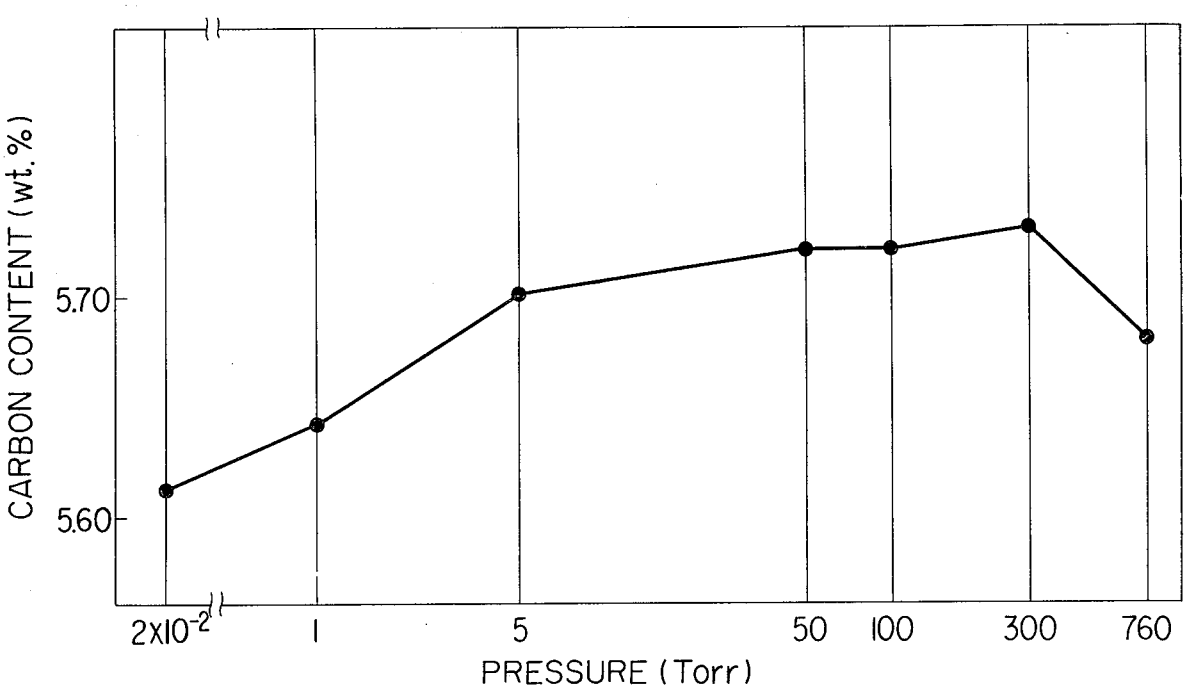
FIG. 1 is a graph showing the change of the carbon content of a cemented carbide alloy when the hydrogen pressure is changed in a furnace.

In the sintering step for cemented carbides, the oxygen contained in the powder is reduced with carbon, resulting in fluctuation of the carbon content. Thus, it has hitherto been proposed to reduce this with hydrogen or carbon monoxide in addition to carbon, but in this method, the reaction system is more complicated and it is a matter of common knowledge, in the end, that sintering in vacuum is most stable.

We, the inventors, have thought that a drastic modification of the sintering method is necessary in order to make it easier to control the carbon content and have made basic studies on removal of gases generated in a compact with pores on the order of a micron, typical of the sintering behavior of cemented carbides and on the diffusion phenomenon of the gases. As a result of this study, the inventors have reached a conclusion that vacuum atmosphere is not always desirable from a viewpoint of removal of the gases.

A gas generated in a compact passes through pores of $1\mu$ or less in diameter and leaves, but, in vacuum, the gas is hard to leave because the mean free path of the gas is increased. Since the mean free path is increased with the decrease of a pressure, a pressure reduced but relatively high is rather desirable. When the inside of a furnace is under a reduced pressure using a gas such as hydrogen or carbon monoxide, on the other hand, a counter diffusion takes place between a generated gas and feed gas. The gas diffusion coefficient D has the following relation:

$$D \propto 1/P$$

(P: pressure) and thus a low pressure is desirable in this case.

That is to say, the rate of the reducing reaction in such pores is influenced by the mean free path of the gas and gas diffusion coefficient as described above and, accordingly, it is highest in some pressure range. It is experimentally found that this pressure range is from 10 Torr to 300 Torr.

Furthermore, it is found that when a large quantity of a gas is fed to a furnace at a stretch, a large quantity of a product gas ($H_2O$ in the case of $H_2$, $CO_2$ in the case of CO) is rapidly generated to cause an oxidation phenomenon in the pores again. In order to prevent this phenomenon, it is necessary to dilute the gas concentration and to effect the reaction gradually. In this case also, the reducing reaction is preferably carried out under reduced pressure.

In the sintering technique of cemented carbides, in particular, it is important both to remove oxygen contained in the powder and to prevent carburization from the ambient atmosphere. If a large quantity of a reducing gas ($H_2$, CO) is fed to a sintering furnace, carburization takes place from the ambient atmosphere in some cases and, therefore, this phenomenon can be suppressed by diluting the gas concentration.

It will clearly be understood from the foregoing illustration that the method comprising controlling the ambient atmosphere under reduced pressure is most suitable for sintering fine powders such as starting mixed powders for cemented carbides. The present invention, based on this finding, provides a sintering technique capable of bringing marked effects or advantages unexpected from the sintering in a hydrogen stream, sintering in vacuum and sintering in a combination of hydrogen and vacuum as well known in the art.

In accordance with the present invention, there is provided a process for producing sintered hard metals which comprises sintering a compact or pressed powder body for the sintered hard metal, a part or all of the heating steps and cooling steps being carried out in both atmospheres of hydrogen and carbon monoxide. According to this process, the properties of the product can precisely be controlled. In this process, the compact can be subjected to a presintering treatment and, optionally, to a forming or machining treatment before the sintering. That is to say, a preferred process for producing cemented carbides comprises sintering a compact for the cemented carbide alloy or a formed body obtained therefrom through a presintering treatment and, if necessary, a machining treatment, a part or all of the heating or temperature-raising steps being carried out in both an atmosphere of hydrogen and an atmosphere of carbon monoxide and a preferred apparatus for producing cemented carbides by sintering a compact for the cemented carbide alloy or a formed body obtained therefrom through a presintering treatment and, if necessary, a machining treatment, comprises a furnace to be charged with a compact, the furnace having a gas inlet, a gas outlet and an exhaust means, in which the gas flow rate to the furnace is controlled by a valve fitted to the gas inlet, the inner pressure of the furnace is controlled by a valve fitted between the gas outlet and the exhaust means and heating or temperature-raising is carried out with a predetermined gas flow rate and pressure.

In a preferred embodiment of the present invention, the sintering is carried out in both an atmosphere of hydrogen and an atmosphere carbon monoxide under reduced pressure, preferably a pressure of 300 Torr or less.

In another preferred embodiment of the present invention, a part or all of the temperature-raising steps at a temperature of lower than a predetermined temperature of 800° to 1200° C. is carried out in a hydrogen atmosphere and a part or all of the temperature-raising steps higher than the predetermined temperature is carried out in a carbon monoxide atmosphere.

In a further embodiment of the present invention, the pressure of the hydrogen atmosphere is 10 Torr or more. The sintered hard metals or alloys obtained by the above described process include generally hard alloys comprising a hard phase consisting mainly of at least one selected from the group consisting of carbides, nitrides, carbonitrides, borides and silicides of the Group IVa, Va and VIa elements (Ti, Zr, Hf, V, Nb, Ta, Cr, Mo, W) of Periodic Table and their mixtures or solid solutions, and a binder metal phase consisting mainly of at least one of iron group metals. Typical of these sintered hard alloys are tungsten-based cemented carbides or carbonitrides. For example, tungsten carbide based cemented carbides include the system WC—Co or -other iron group metal, optionally with carbides of titanium, tantalum, niobium, hafnium, zirconium, chromium and vanadium, i.e., which consists of 70–96% tungsten carbide and 4–30% cobalt or, if necessary, up to 50% of the tungsten carbide being substituted by one or more of carbides of titanium, tantalum, niobium, hafnium, zirconium, chronium and vanadium.

The important features of the present invention consist in (1) sintering under a reduced pressure of 300 Torr or less, (2) flowing a gas under reduced pressure and (3) using a hydrogen atmosphere and carbon monoxide atmosphere in combination in a part or all of the temperature-raising steps.

The first feature is that the gas generated during the reaction is very mobile because the gas counter diffusion coefficient D is in inverse proportion to pressure. When using hydrogen under reduced pressure, for example, the hydrogen gas is diffused well through pores of a compact and the water generated in the pores is apt to come out of the pores by the counter diffusion with the hydrogen gas. Experimental results teach that it is possible to sufficiently control the gas diffusion on a commercial scale and a condition required for effecting the reduction sufficiently is to adjust the pressure to 300 Torr or less. If the pressure is more than 300 Torr, removal of the water generated in pores is impossible, resulting in marked decrease of the reducing efficiency.

The second feature is to flow the gas in the furnace. That is to say, the pressure inside the furnace is kept at 300 Torr or less while a gas is fed continuously to the furnace. The feeding of a gas is only to activate the gas counter diffusion in the furnace and, if the gas is not fed, the pressure of $H_2O$ in the furnace is increased giving unfavorable results. The gaseous composition can voluntarily be controlled by the method wherein a gas is continuously fed with control of the exhaust to thus control the partial pressure in the furnace.

The third feature is to use a hydrogen atmosphere and carbon monoxide atmosphere properly in two stages. That is to say, a hydrogen atmosphere is preferable to remove the oxygen on the surface of an oxidized powder and a carbon monoxide atmosphere is preferable to remove the oxygen in the interior of the powder. In the process of the present invention, the quantity of decarburization is controlled by using properly gaseous atmospheres of hydrogen and carbon monoxide in two stages. Therefore, the use of a single gaseous atmosphere has no effects. For example, if the sintering is carried out in hydrogen only, the reducing reaction only proceeds at a low temperature such as up to 800° C., which is favorable, but, at a high temperature such as 1200° C. or higher, the water formed through the reducing reaction with hydrogen is reacted with carbon ($C+H_2O \rightarrow CO+H_2$), resulting in decarburization and, consequently, fluctuation of the carbon content is increased, which is rather unfavorable. Therefore, feeding of hydrogen should be stopped at 1200° C. or less and, in practice, it may be stopped at 800° to 1200° C. If carbon monoxide gas is fed at a lower temperature, on the other hand, carbon is markedly precipitated by the reaction of $2CO \rightarrow C+CO_2$. Therefore, feeding of carbon monoxide should be carried out at least within a temperature range wherein carbon monoxide is stable. That is to say, the temperature range within which carbon is not precipitated and the reduction is well carried out is 800° to 1200° C. considering the reduced pressure, which is analogous to that at which feeding of hydrogen is stopped.

Thus, the inventors have succeeded in suppressing strictly the fluctuation of the carbon content of cemented carbides by changing a hydrogen atmosphere to a carbon monoxide atmosphere at a suitable temperature between 800° and 1200° C.

The present invention will now be illustrated in detail by the accompanying drawings:

FIG. 1 shows the change of the carbon content of a cemented carbide alloy when the hydrogen pressure in a furnace is changed. As can be seen from this graph, the decarburization is best suppressed at a hydrogen pressure of 5 to 300 Torr. This depends upon the gas diffusion speed, quantity of hydrogen and reaction speed.

Figure 2:
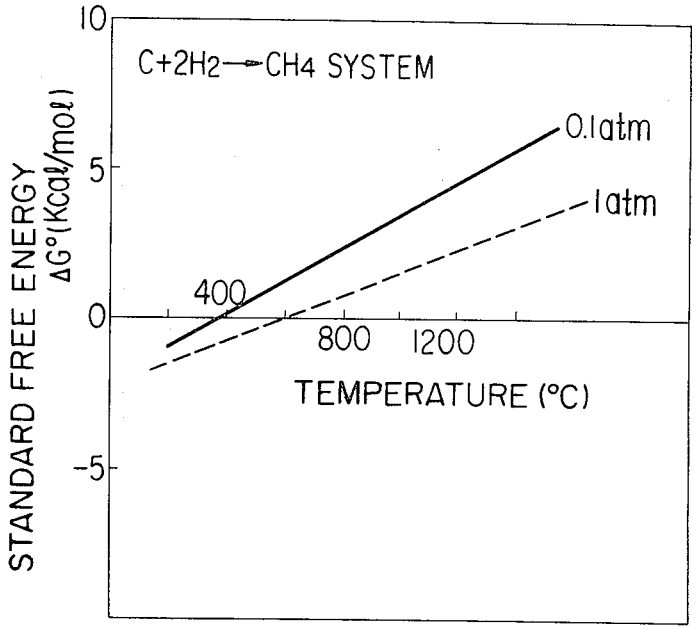
FIG. 2 is a graph showing the relation of the standard free energy of the reaction $C+2H_2 \rightarrow CH_4$ with temperatures.

FIG. 2 shows the standard free energy of the reaction of hydrogen with carbon to form methane. As can be seen from this graph, under reduced pressure, the quantity of methane formed is decreased and this shows that the carburization phenomenon can be prevented, which is often a problem in the prior art hydrogen furnace.

Figure 3:
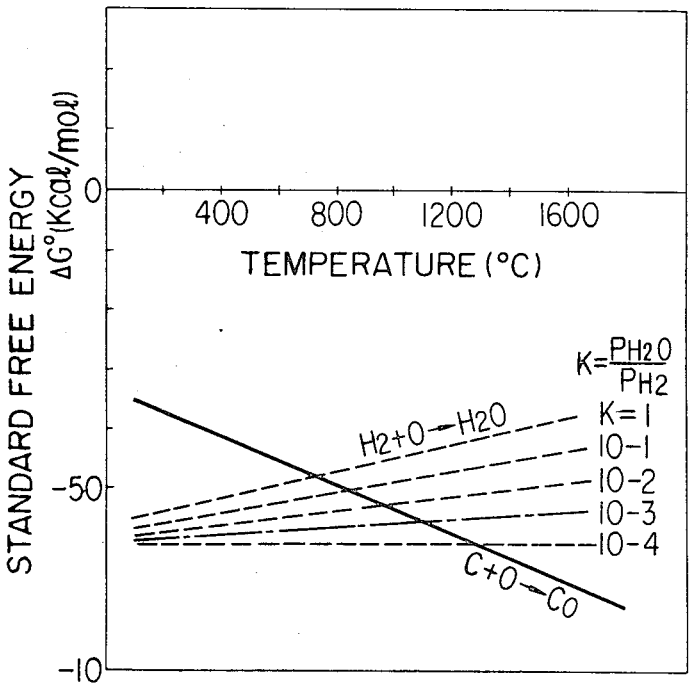
FIG. 3 is a graph showing the relation of the standard free energies of reducing reactions using carbon and hydrogen with temperatures.

FIG. 3 shows the standard free energies for the purpose of illustrating which is more liable to take place, hydrogen reduction or carbon monoxide reduction. The preference of either the hydrogen reduction or the carbon monoxide reduction is determined by the partial pressure of $H_2O$ in $H_2$, in particular, the ratio of $P_{H2O}/P_{H2}$ in a compact and the temperature range in this case is 800° to 1200° C.

Figure 4:
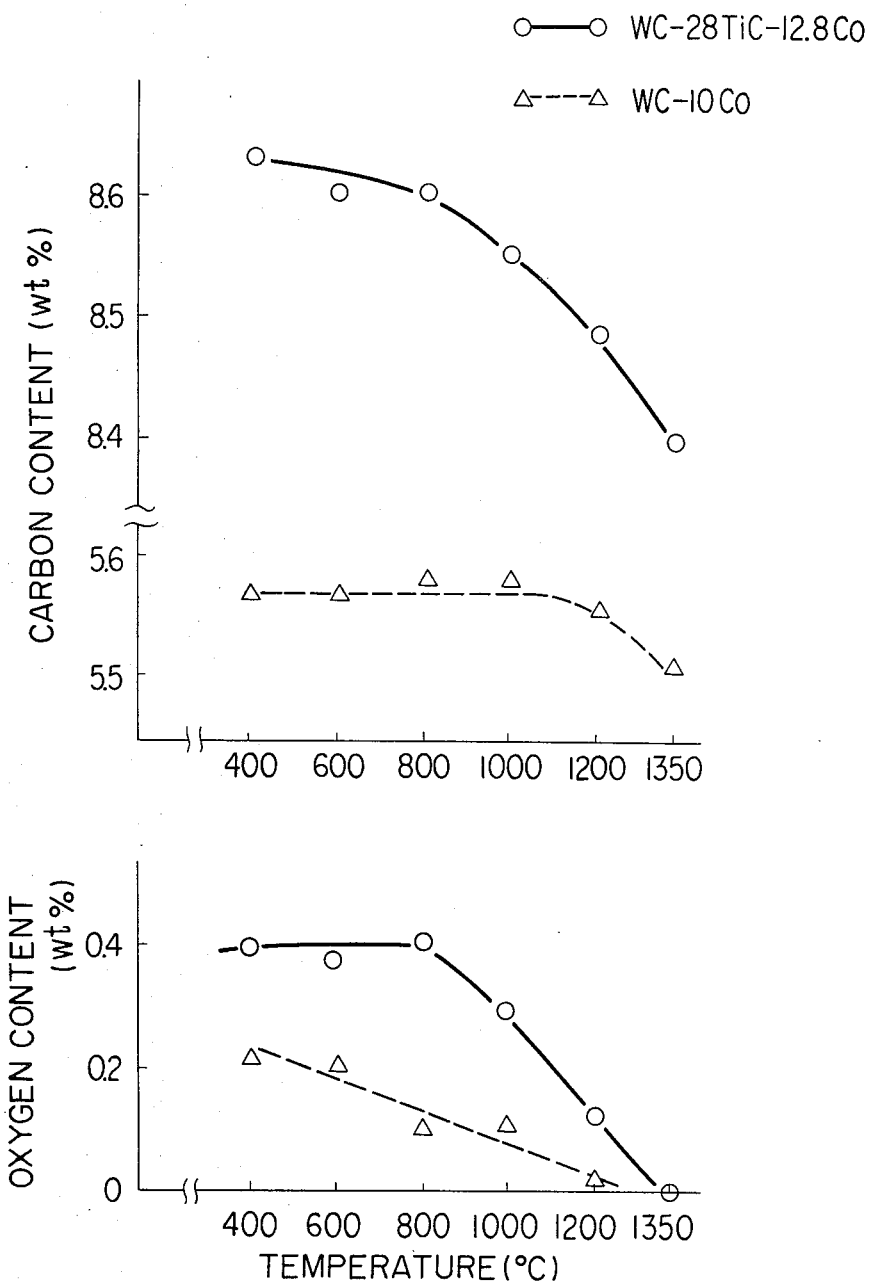
FIG. 4 (*a*) and (*b*) are graphs showing respectively the change of the quantities of carbon and oxygen when compacts for cemented carbides WC—28TiC—12.8Co and WC—10Co are heated.

FIG. 4 shows the change of the quantities of carbon and oxygen when compacts for cemented carbides are heated. In comparison of a WC—Co composition and WC—TiC—Co composition as to quantities of decarburization and deoxidation, the latter TiC-containing alloy shows a larger extent of decarburization and deoxidation at a temperature of 1000° C. or higher. This shows that oxides of Ti, Ta, Nb, etc. are hard to reduce with hydrogen and thus subjected to reduction with carbon monoxide in many cases. In these cases, it is required to increase the partial pressure of carbon monoxide and to effect sufficiently the reduction at a high temperature. On the other hand, in the case of WC-Co type alloys in which the proportion of such a high temperature reduction is smaller, the partial pressure of carbon monoxide can be lowered. If the oxygen can be removed enough by the hydrogen reduction, the effects can sufficiently be realized even under a CO partial pressure of 0.1 Torr or less. The temperature when carbon monoxide gas is fed can be chosen from a range of 800° to 1200° C., but the temperature when the feeding of carbon monoxide is stopped varies with the intended object. If the sintering atmosphere is kept uniform throughout, for example, it would be expected that deformation during the sintering can be prevented and solidification can evenly be accomplished. In the case of aiming at removing a gas in an alloy, feeding of the gas is stopped when the reduction is completed well after a liquid phase appears and the system is changed to high vacuum, thus obtaining a high quality alloy.

The effects or advantages according to the present invention can be given by feeding hydrogen at a low temperature range and carbon monoxide at a high temperature range. In this case, optionally, the hydrogen gas can be used in admixture with argon, nitrogen and other gases and the carbon monoxide gas can be used in admixture with hydrogen, argon, a very small quantity of carbon dioxide and other gases. Furthermore, the feeding of these gases can be carried out intermittently with good results. When the hydrogen gas is changed to the carbon monoxide gas, evacuation of the system can be carried out without deteriorating the effects of the present invention so much, but it is desirable to keep a carbon monoxide atmosphere at 1200° C. in order to obtain the effectiveness of carbon monoxide.

The use of a gaseous atmosphere in the cooling step in the process of the present invention has also some effects or merits in some cases. One of the effects is that the cooling speed of a sintered body can be increased due to the larger thermal conductivity than in vacuum and the binder phase can be strengthened by the rapid cooling. In this case, of course, a hydrogen gas having a relatively large thermal conductivity has marked effects.

When a cemented carbide alloy is sintered by the sintering method of the present invention as described above, it is confirmed that a product with a very uniform quality can be obtained in stable manner. Moreover, it is found that a partial precipitation of free carbon and formation of a brittle $\eta$-phase, being unavoidable in the prior art vacuum sintering method, can be suppressed and a bending strain occurring in a large length product by sintering can also be suppressed.

For the purpose of carrying out most effectively the sintering process of the invention, an apparatus is required which is capable of continuously flowing a gas and reducing the inner pressure to keep sufficient the diffusion of the gas in the furnace.

It has been proposed, as to a hydrogen atmosphere at a low temperature side, to effect sintering in a pulsating hydrogen atmosphere (Japanese Patent Application (OPI) No. 62304/1974). This proposal is based on the concept that $H_2O$ formed in a compact to be sintered is removed by pulsating the pressure, whereby the reducing reaction with $H_2$ is promoted and the reaction of $H_2O$ with C occurring at a high partial pressure of $H_2O$ is prevented. This is very interesting, but has the following important disadvantages in a practical experiment. The first disadvantage is that a complicated and expensive apparatus or installation is necessary for pulsating. The second disadvantage is that the temperature of a furnace is largely fluctuated by the pulsated hydrogen pressure in the furnace due to high heat conductivity of hydrogen and a very expensive installation is required for controlling this automatically.

The inventors have made studies on a method which can readily be realized and, consequently, have reached the conclusion that the object of the reduction can sufficiently be achieved in an atmosphere within a pressure range of 300 Torr or less.

Figure 5:
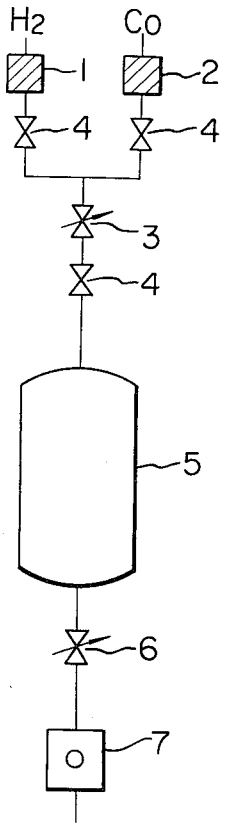
FIG. 5 is a diagrammatic view of one embodiment of the apparatus according to the present invention.

An apparatus suitable for this purpose is as shown in FIG. 5. This apparatus can readily be provided by adding a cheap auxiliary means to the prior art vacuum furnace, which is very significant on a commercial scale. That is to say, the flow rate of a gas is controlled by fitting a valve to a gas feed inlet in a vacuum furnace and the pressure in the furnace is controlled by fitting a valve to a gas outlet in communication with an exhaust means and controlling the opening degree of the valve.

The present invention will be explained in detail with reference to the following examples and comparative examples. It will be obvious to one skilled in the art that various changes and modifications can be made in the components, ratios, operational order and the like without departing from the spirit of the present invention. Therefore, the present invention should not be construed as being limited to the following examples. In these examples, percents are to be taken as those by weight unless otherwise indicated.

EXAMPLE 1

As shown in FIG. 5, conduits for hydrogen and carbon monoxide, flow meters and valves were fitted to gas feed inlets in the prior art vacuum furnace and a valve capable of precisely controlling the pressure was provided between a gas outlet and vacuum pump.

25 kg of a compact having a composition of WC-7% Co and prepared from WC powder having a mean particle size of 3 microns and Co having a mean particle size of 1 micron, which had been subjected to a presintering and a forming treatment, was charged on a graphite sheet in a vacuum furnace of the prior art having an inner diameter of 800 mm $\phi$. This compact had ordinarily a problem as described hereinafter depending upon the period of time when it was stored in a molding chamber. In the vacuum furnace, graphite was used as a heating element.

The furnace was firstly evacuated to $10^{-2}$ Torr by means of the vacuum pump and hydrogen with a pressure of 300 mm water column was gradually fed through the gas inlet valve at a flow rate of 10 l/min to the furnace. During the same time, the outlet valve was completely opened. Thereafter, the outlet valve was gradually closed to adjust the pressure in the furnace to 100 Torr and electric current was passed through the heating element. At 1000° C., the gas inlet valve was closed, the outlet valve was completely opened and the system was evacuated to $5\times10^{-1}$ Torr or less. Then the carbon monoxide inlet valve was opened to introduce carbon monoxide at a flow rate of 2 l/min and the outlet valve was gradually closed to adjust the pressure in the furnace to 50 Torr, followed by heating to 1400° C. The inlet valve was closed, the outlet valve was completely opened and the system was evacuated to a vacuum of $1\times10^{-1}$ Torr or less, followed by maintaining these conditions for 1 hour and cooling in vacuum.

The sintered body obtained in this way had uniform and excellent properties, which was an unexpected result because in the ordinary vacuum sintering, another compact as used in this example showed an uneven degree of decarburization and formation of a brittle phase with a probability of 50% or more.

In the following examples, the similar procedures were repeated using the similar type apparatus to this example. The purity of the hydrogen used was represented by a dew point of −31° C. and the carbon monoxide had a purity of 99.9%.

EXAMPLE 2

A powder having a composition of WC-10% Co was ball milled by wet process using acetone and the acetone was then removed. Due to a misoperation at that time, however, water entered the powder and the powder was largely wetted. When this powder was pressed and subjected to vacuum sintering, decarburization proceeded to a greater extent to give unfavorable results.

In order to prevent this, a test was carried out using the apparatus of Example 1. In this test, 300 g of a charge was used and sintering was carried out with flowing hydrogen at a flow rate of 3 l/min and carbon monoxide at a flow rate of 0.5 l/min to obtain an excellent sintered body. This test is an extreme case, but in other cases wherein the conditions are not so extreme, the similar effects for stabilizing the quality of cemented carbides would be expected.

EXAMPLE 3

A starting mixed powder having a composition of WC-10% Co was prepared from WC powder having a mean particle size of 0.5 micron and Co powder having a mean particle size of 1 micron. This powder was very fine and showed a BET value of 6 $m^2/g$. This powder was allowed to stand in the air for one week, pressed in a form of $15\times15\times10$ mm (hexahedron) and sintered by the following two procedures using a sintering furnace having an inner volume of 30 liter:

| Method | Heating Condition | Atmosphere |
|---|---|---|
| (A) Present Invention | Room Temperature→1000° C. | $H_2$ 100 Torr 1 l/min |
| | 1000° C.→1350° C. | CO 20 Torr 0.5 l/min |
| | 1350° C.→1380° C. | Vacuum $5\times10^{-2}$ Torr |
| (B) Prior Art | Room Temperature→1100° C. | Vacuum $3\times10^{-1}$ Torr |
| | 1100° C.→1380° C. | Vacuum $5\times10^{-2}$ Torr |

In the present invention (A), a good sintering was completed, while in the prior art method (B), a brittle $\eta$-phase occurred.

EXAMPLE 4

The starting mixed powder of Example 3, immediately after preparing the powder, was pressed in a hexahedron of $50\times50\times20$ mm, subjected to presintering at 600° C. and then to a forming treatment in a hexahedron of $15\times15\times10$ mm. 15 days were required from the presintering to the forming treatment.

The resulting compacts were sintered by the sintering methods of Example 3 and compared. In the present invention, a good sintering was completed, while in the prior art method, a brittle $\eta$-phase occurred.

It will clearly be understood from Examples 3 and 4 that sintering of a fine starting mixed powder is completed in stable manner according to the present invention in spite of that the starting mixed powder used in Example 3 and 4 is so fine that the oxidation proceeds rapidly and the production is not easy by the prior art vacuum sintering method.

EXAMPLE 5

A starting mixed powder having a composition of WC-8%Tic-10% Co was prepared from WC powder having a mean particle size of 2 microns, (Ti, WC) powder having a particle size of 3 microns and Co powder having a mean particle size of 1 micron, and then pressed in a hexahedron of $15\times15\times10$ mm. 100 samples thus prepared were sintered by each of the following sintering methods using a sintering furnace having an inner volume of 200 liter:

| Method | Heating Condition | Atmosphere |
|---|---|---|
| (A) Present Invention | Room Temperature→1000° C. | $H_2$ 100 Torr 1.5 l/min |
| | 1000° C.→1400° C. | CO 20 Torr 3 l/min |
| | 1400° C. | Vacuum $1\times10^{-2}$ Torr |
| (B) Prior Art | Room Temperature→1200° C. | Vacuum $3\times10^{-1}$ *Torr* |
| | 1200° C.→1400° C. | Vacuum $5\times10^{-2}$ Torr |
| | 1400° C. | Vacuum $1\times10^{-2}$ Torr |
| (C) Prior Art | Room Temperature→600° C. | $H_2$ 760 Torr 30 l/min |
| | 600° C.→1400° C. | Vacuum $1\times10^{-1}$ Torr |

The sintered states of the 100 samples are respectively as follows:

| Method | Good | $\eta$-Phase Deposition | Free Caron Deposition |
|---|---|---|---|
| (A) | 100 | 0 | 0 |
| (B) | 81 | 19 | 0 |
| (C) | 52 | 34 | 14 |

In the present invention, all the samples show good results, but in the case of using $H_2$ at 760 Torr, a number of inferior products are formed. In the case of the vacuum sintering, carbon tends to be lacking.

EXAMPLE 6

100 inserts obtained in Example 5 were subjected to a cutting test by the following conditions:

Workpiece: SCM 3
Cutting Speed: 110 m/min
Feed: 0.36 mm/rev
Cutting Depth: 1.5 mm
Time: 20 minutes
Tool Shape: SNG 432

The life of the samples were measured when the flank wear reached 0.25 mm or more to obtain results tabulated below:

| Sample | Broken | Flank Wear 0.25 mm or more | Flank Wear less than 0.25 mm |
|---|---|---|---|
| A | 0 | 2 | 98 |
| B | 3 | 28 | 69 |
| C | 16 | 38 | 46 |

It is apparent from Examples 5 and 6 that in the present invention, cemented carbides with uniform properties can be obtained, while in the prior art method, deviations in properties are very large.

EXAMPLE 7

The same WC-7% Co powder as that of Example 1 was used and sintered under the following conditions to examine the influence of the pressure of atmosphere:

| | | Room Temperature 1000° C. | 1000° C. 1400° C. |
|---|---|---|---|
| Prior Art | A | Vacuum of $3\times10^{-1}$ Torr or less | Vacuum of $5\times10^{-2}$ Torr or less |
| Present Invention | B | $H_2$ 1 Torr 10 l/min | Co 50 Torr 2 l/min |
| | C | $H_2$ 5 Torr 10 l/min | " |
| | D | $H_2$ 50 Torr 10 l/min | " |
| | E | $H_2$ 100 Torr 10 l/min | " |
| | F | $H_2$ 300 Torr 10 l/min | " |
| Prior Art | G | $H_2$ 700 Torr 10 l/min | Vacuum of $5\times10^{-2}$ Torr or less |

In the each case, using a sintering furnace having an inner volume of 100 liters, 100 samples in a hexahedron of $15\times15\times10$ mm were respectively sintered to examine the dispersion of the carbon contents in the final alloys with the pressures of atmosphere. The mean values and standard deviations of the carbon contents are tabulated below:

| | A | B | C | D | E | F | G |
|---|---|---|---|---|---|---|---|
| Mean Percent by Weight | 5.72 | 5.72 | 5.73 | 5.72 | 5.72 | 5.72 | 5.75 |
| Standard Deviation | 0.12 | 0.08 | 0.02 | 0.03 | 0.02 | 0.03 | 0.15 |

In the present invention, fluctuation of the carbon contents is small, while in the prior art methods A and G, it is considerably large.

EXAMPLE 8

A starting mixed powder having the same composition as that of Example 7 was pressed in a hexahedron of $50\times50\times20$ mm, subjected to presintering in vacuum at 600° C. and then to a forming treatment in a hexahedron of $15\times15\times8$ mm. After 15 days were passed from the day of the presintering, samples thus prepared were sintered by the sintering methods shown in Example 7 to examine the carbon contents:

| | A | B | C | D | E | F | G |
|---|---|---|---|---|---|---|---|
| Mean Percent by Weight | 5.61 | 5.64 | 5.70 | 5.72 | 5.72 | 5.73 | 5.68 |
| Standard Deviation | 0.20 | 0.18 | 0.03 | 0.02 | 0.03 | 0.02 | 0.24 |

As apparent from the results of Examples 7 and 8, the dispersion of the carbon contents is very small under a pressure of 5 to 300 Torr according to the present invention, 95% or more of which are within a range of ±0.03%, while in the prior art method A or in the method using $H_2$ at 1 atm, there occur remarkable dispersions. These results correspond well to those of Examples 5 and 6 and thus make clear the effects of the present invention.

EXAMPLE 9

A starting mixed powder having a composition of WC-10% Co was prepared from WC powder having a mean particle size of 1 micron and Co powder having a mean particle size of 1 micron and pressed in a hollow cylinder of $50\phi\times10\phi\times50$ mm. 20 samples thus prepared were respectively sintered by each of the following sintering methods:

| | Heating Condition | Atmosphere |
|---|---|---|
| (A) Present Invention | Room Temperature→1000° C.<br>1000° C.→1380° C. | $H_2$ 100 Torr 10 l/min<br>CO 150 Torr 3 l/min |
| (B) Prior Art | Room Temperature→1000° C.<br>1000° C.→1380° C. | Vacuum $3\times10^{-1}$ Torr<br>Vacuum $5\times10^{-2}$ Torr |

In the products of this kind, a partial precipitation of free carbon has hitherto occurred often by carburization from a carbon sheet and such products have been rejected. The number of the partially carburized products in the above described sintering methods are as follows:

| | (A) | (B) |
|---|---|---|
| First Time | 1 | 9 |
| Second Time | 0 | 6 |
| Third Time | 0 | 11 |

As can be seen from these results, in the present invention, free carbon is scarcely found, while in the prior art method, free carbon appears in many cases. That is to say, the process of the present invention is excellent in stability.

EXAMPLE 10

Figure 6:
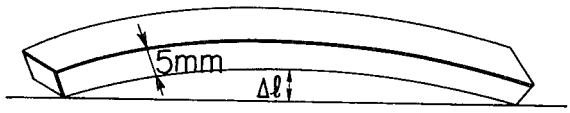
FIG. 6 is a schematic view of bending of a sheet caused by sintering.

From the same starting mixed powder as used in Example 9, a thin sheet of $300\times20\times5$ mm was prepared through a presintering treatment and machining treatment. 10 samples thus prepared were respectively sintered by the sintering methods of the present invention (A) and the prior art (B) to examine the number of inferior products formed, which had a bending length $\Delta l$ in the longitudinal direction of 1.5 mm or more between the center and end, as shown in FIG. 6.

| | |
|---|---|
| (A) Present Invention | 0 |
| (B) Prior Art Method | 6 |

As apparent from this result, formation of such an inferior product can be suppressed according to the present invention, while in the prior art method, a considerable number of inferior articles are unavoidable with a probability of 50% or more. A very high working or machining cost is required for correcting the dimensionally inferior article because of the high hardness of cemented carbides. In this respect, the present invention renders great services to the industry and provides a sintering methods capable of satisfying the severe requisites for dimensional precision of cemented carbides.

EXAMPLE 11

A starting mixed powder having a cermet composition of TiC-10% $Mo_2C$-12% Ni was prepared from TiC powder having a mean particle size of 1 micron, $Mo_2C$ powder having a mean particle size of 1 micron and Ni powder having a mean particle size of 0.8 micron and pressed in a hexahedron of 15×15×8 mm. The so obtained samples were sintered by the following two methods:

| | Heating Condition | Atmosphere |
|---|---|---|
| (A) Present Invention | Room Temperature→800° C.<br>800° C.→1380° C.<br>1380° C. × 1 hour | $H_2$ 80 Torr 2 l/min<br>CO 20 Torr 1 l/min<br>Vacuum $1\times10^{-2}$ Torr |
| (B) Prior Art | Room Temperature→1200° C.<br>1200° C.→1380° C.<br>1380° × 1 hour | Vacuum $5\times10^{-1}$ Torr<br>Vacuum $1\times10^{-2}$ Torr<br>Vacuum $1\times10^{-2}$ Torr |

In this case, a sintering furnace having an inner volume of 30 liters was used. In the present invention, pores were hardly found in the products and cutting can normally be effected, while in the prior art method, there were a number of pores with a mean diameter of about 15 microns in the products and they were not suitable as a cutting tool.

EXAMPLE 12

A starting mixed powder having a composition of $Cr_2C_3$-20% Ni was prepared from $Cr_2C_3$ powder having a mean particle size of 4 microns and Ni powder having a mean particle size of 3 microns, mold-passed in a hexahedron of 30×30×20 mm and then sintered by each of the following sintering methods:

| | Heating Condition | Atmosphere |
|---|---|---|
| (A) Present Invention | Room Temperature→1000° C.<br>1000° C.→1450° C. | $H_2$ 100 Torr 10 l/min<br>CO 10 Torr 1 l/min |
| (B) Prior Art | Room Temperature→1450° C. | Vacuum $5\times10^{-2}$ Torr |

In the present invention (A), a sintered body having few cavities and a density of 99.9% or more of the theoretical density was obtained, but in the prior art method, a sintered body having a number of cavities and a density of about 96% of the theoretical density was only obtained.

What is claimed is:

1. A process for controlling the carbon content of cemented carbides or cemented carbide alloys during sintering comprising:

(a) heating a cemented carbide or cemented carbide alloy compact to a first temperature between 800° and 1200° C. in a flowing atmosphere consisting essentially of hydrogen at a pressure of 300 torr or less, said temperature being sufficient to cause deoxidation of the compact but below the temperature which results in appreciable decarburization by hydrogen;

(b) removing said hydrogen atmosphere at said first temperature; and (c) continuing to heat the powder body from said first temperature to the sintering temperature of the compact in a flowing atmosphere consisting essentially of carbon monoxide gas at reduced pressure.

2. The process as claimed in claim 1, wherein the compact is subjected to a presintering treatment and, with or without a forming or machining treatment before the sintering.

3. The process as claimed in claim 1, wherein the atmosphere of hydrogen has a pressure of at least 10 Torr.

4. The process as claimed in claim 1, wherein the hydrogen is used in admixture with at least one member selected from the group consisting of argon, nitrogen and carbon monoxide.

5. The process as claimed in claim 1, wherein the atmosphere of carbon monoxide has pressure of at most 300 Torr.

6. The process as claimed in claim 1, wherein the carbon monoxide is used in admixture with at least one member selected from the group consisting of hydrogen, argon, and carbon dioxide.

* * * * *